US005172955A

United States Patent [19]

Freese et al.

[11] Patent Number: 5,172,955

[45] Date of Patent: Dec. 22, 1992

[54] BOUNCING INFANT SEAT RECLINING BETWEEN UPRIGHT POSITION AND RECLINE POSITION WITH DISTINCT RESILIENT ELEMENT

[75] Inventors: Theodore B. Freese, Westminster; Robert M. Parker, Aurora; Gregg W. Harvey, Boulder, all of Colo.

[73] Assignee: Gerry Baby Products Company, Denver, Colo.

[21] Appl. No.: 662,273

[22] Filed: Feb. 28, 1991

[51] Int. Cl.[5] ..... A47C 3/00

[52] U.S. Cl. ..... 297/302; 297/328; 248/608

[58] Field of Search ..... 297/19, 16, 285, 294–298, 297/300–304, 306, 357, 358, 374, 325–328, 457, 274, 275; 5/101, 102, 104, 105, 106, 108, 431–433; 248/139, 190, 185, 608; 403/61, 85, 100, 95

[56] References Cited

U.S. PATENT DOCUMENTS

| | | | |
|---|---|---|---|
| 3,004,793 | 10/1961 | Loomis | 297/274 |
| 3,101,972 | 8/1963 | Laughlin . | |
| 3,161,720 | 12/1964 | Musichuk | 248/188.6 |
| 3,572,827 | 3/1971 | Merelis et al. | 297/328 X |
| 4,072,318 | 2/1978 | Laune | 297/328 X |
| 4,081,869 | 4/1978 | Ash . | |
| 4,188,678 | 2/1980 | Rawolle . | |
| 4,205,877 | 6/1980 | Ettridge . | |
| 4,274,674 | 6/1981 | Deloustal . | |
| 4,359,045 | 11/1982 | Cozzi | 5/531 X |
| 4,553,786 | 11/1985 | Lockett, III et al. . | |
| 4,976,494 | 12/1990 | Polley | 297/296 X |
| 4,982,997 | 1/1991 | Knoedler et al. | 297/296 |

FOREIGN PATENT DOCUMENTS

| | | | |
|---|---|---|---|
| 1554018 | 1/1970 | Fed. Rep. of Germany | 297/457 |
| 1429369 | 8/1966 | France | 297/326 |

*Primary Examiner*—Peter R. Brown
*Assistant Examiner*—James M. Gardner
*Attorney, Agent, or Firm*—Thompson, Hine and Flory

[57] ABSTRACT

An infant seat having a seating surface positionable between upright and reclined orientations, the seating surface being supported by arms which are connected to torsion springs in a base, the torsion springs providing a bouncing motion to the seating surface in both the upright and reclined orientations. The base includes a rear support member which pivots between a support position, in which the member is substantially coplanar with the base, and a collapsed or folded position, in which the support member is pivoted adjacent to the seating surface. In a preferred embodiment, the connection between the seating surface and support arms includes a pivot plate pivotally connected to the seating surface and support arms and includes a slot engaged by a shoulder rivet attached to the support arms which defines limits of pivotal movement of the seating surface. The rear support member preferably includes nock fittings at its ends which engage the torsion springs and are held in engagement by extension springs captured within the rear support member ends. When the infant seat is adjusted to the collapsed or folded position, the nock fittings are disengaged from the torsion springs and pivoted toward the seating surface.

15 Claims, 6 Drawing Sheets

BOUNCING INFANT SEAT RECLINING BETWEEN UPRIGHT POSITION AND RECLINE POSITION WITH DISTINCT RESILIENT ELEMENT

BACKGROUND OF THE INVENTION

The present invention relates to infant seats and, more particularly, to infant seats having reclining seating surfaces and which are collapsible.

There are several varieties of infant seats. One type, of which the seat disclosed in Laughlin U.S. Pat. No. 3,101,972 is typical, comprises a seat shell made of plastic or other inflexible material which includes a soft pad along its length. The seat shell is pivotally connected to a wire frame base which, in turn, is pivotally connected to a wire frame back support. The back support is attachable to the seat shell at plurality of locations along its length, the angle of inclination of the seat shell being determined by the selected connection point of the back support. While such infant seats recline from a substantially upright position, for larger infant seating, to a reclined position, appropriate for smaller infants, these seats do not move or "bounce," which often is desirable to pacify the infant.

Another type of infant seat, of which the seats disclosed in the Rawolle U.S. Pat. No. 4,188,678 and Lockett, III et al. U.S. Pat. No. 4,553,786 are typical, comprises a wire frame which is bent to form a support base and angles upwardly from the base to form a loop that supports a fabric seating surface. Such a seating surface typically includes a belt or strap to hold the infant in place. The curve of the metal frame between the seating loop and the frame acts as a torsion spring which permits the seating surface to be bounced relative to the base, thereby providing a pacifying effect on an infant in the seat.

While such infant seats are sturdy and relatively inexpensive, they are not collapsible and therefore are difficult to carry and store. Further, this type of infant seat does not provide an adjustable seating surface; the seating surface typically is inclined to a degree which is a compromise between an upright position and a reclined position.

A newer type, developed by Gerry Baby Products Company and marketed under the name "Snugli Bouncer," comprises a shell seat made of a plastic material and supported on a wire frame attached to a plastic base. The wire frame acts as a torsion spring to provide a bouncing movement and is pivotally attached to the peripheries of disc handles which are rotatably attached to the seat. Rotation of the disc handles varies the angular orientation of the seat relative to the wire frame and thereby varies the inclination of the seat between an upwardly inclined position and a generally horizontal, carry position. A disadvantage of that design is that the seat cannot be bounced when adjusted to the carry position. Consequently, it is not as easy for smaller-sized infants to bounce in that infant seat.

Accordingly, there is a need for an improved infant seat which is lightweight, positionable between upright and reclined positions, provides a bouncing action in both positions and is collapsible for storage or transportation.

SUMMARY OF THE INVENTION

The present invention is an infant seat in which the seating surface is positionable between upright and reclined positions, is mounted on a base to provide a bouncing action in both positions and in which the support base is collapsible against the seating surface for storage or transportation. The infant seat includes a seat frame for supporting the seating surface, a base having a pair of support arms and pivot assemblies connecting the support arms to the seat frame. Each of the pivot assemblies includes a first pivot connection between the support arms and the frame and a second pivot connection which includes a pivot plate. The pivot plates are pivotally connected both to the seat frame and to the support arms.

In a preferred embodiment, the pivot plates each include a slot which receives a shoulder rivet forming the pivot connection with the associated support arm. The seating surface is pivoted relative to the support arms about the first pivot connection and the range of pivotal movement is confined by the travel of the shoulder rivets within their respective slots in the pivot plates. Accordingly, the seating surface can be positioned in a generally upright configuration or pivoted to a reclined position. The reclined position is not only more comfortable for a smaller infant, it shifts the center of gravity of the infant to give it greater leverage and allow it to bounce more easily. In a preferred embodiment, the pivot plates each include a clip for engaging the associated support arms when the seating surface is oriented in an upright position.

Also in the preferred embodiment, the support arms each are attached to the base by a torsion spring which provides a bouncing action in response to movements of the infant in the seat. The torsion springs each include an inclined segment, a forward segment and a rearward segment, the forward and rearward segments being substantially parallel to each other. The inclined segments are inserted into bushings attached to the ends of the support arms. The forward and rearward segments engage a rear support member which extends rearwardly from the base beneath the seating surface.

The rear support member is generally U-shaped and includes nock fittings in its ends which are shaped to engage the forward segments of the torsion springs. The ends of the support member include slots which receive the rearward segments of the torsion springs. Extension springs are mounted in the ends of the support members between the rearward segments and nock fittings thereby urging the nock fittings and rear support member forwardly against the forward segments of the torsion springs.

The rear support member can be disengaged from the forward segments by pulling the base and rear support member apart, thereby compressing the extension springs. When the nock fittings are disengaged, the rear support member can be pivoted about the rearward segments to a collapsed configuration in which the rear support member is positioned adjacent to the seating surface.

Accordingly, it is an object of the present invention to provide an infant seat which is light weight yet provides a comfortable seating surface for an infant; an infant seat which includes a seating surface positionable between upright and reclined positions; an infant seat in which the seating surface is connected to a support which provides a gentle bouncing action; an infant seat in which the seat base is easily positionable between a support configuration and a collapsed configuration;

and an infant seat which is economical to fabricate and is visually pleasing.

Other objects and advantages of the present invention will be apparent from the following description, the accompanying drawings and the appended claims.

DETAILED DESCRIPTION

Figure 1:
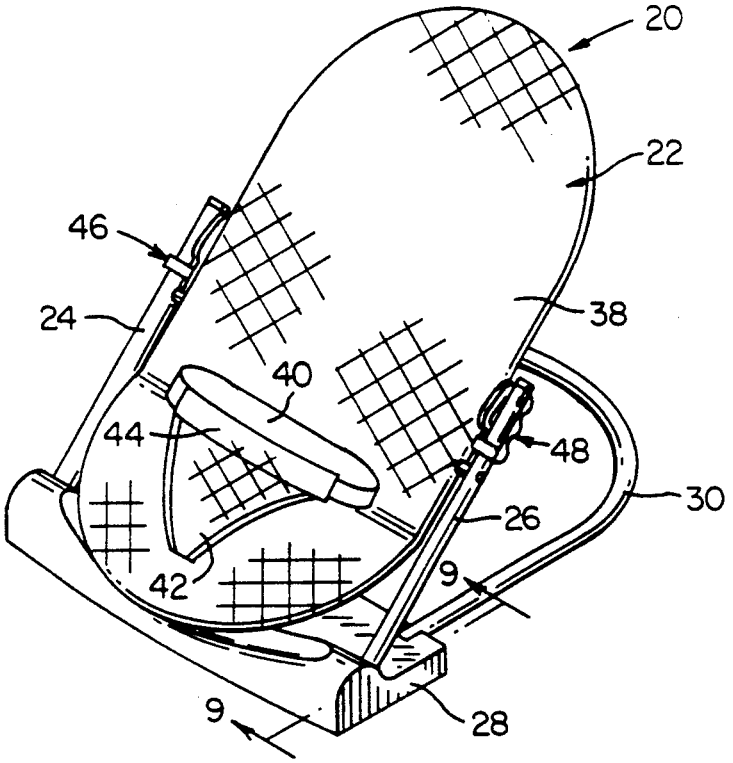
FIG. 1 is a perspective view of a preferred embodiment of the infant seat of the present invention in which the seating surface is adjusted to an upright position.
Figure 2:
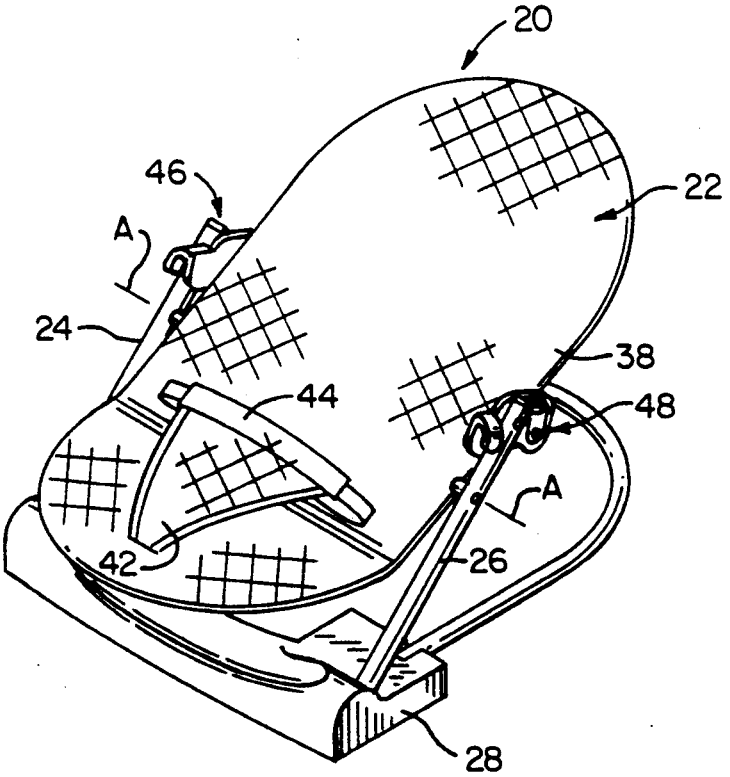
FIG. 2 is a perspective view of the infant seat of FIG. 1 in which the seating surface is adjusted to a reclined position.
Figure 3:
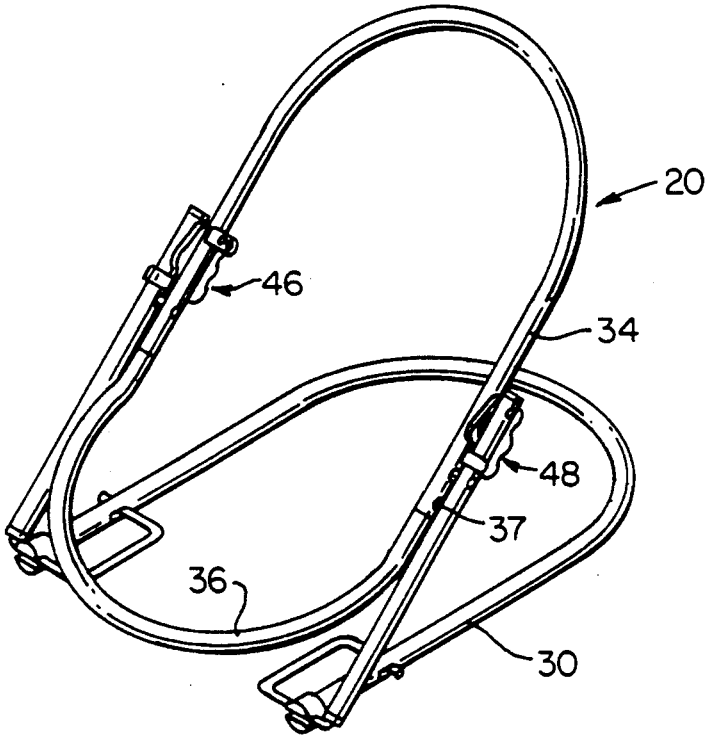
FIG. 3 is a perspective view of the infant seat of FIG. 1 showing the seating support frame.

As shown in FIGS. 1, 2 and 3, the infant seat of the present invention, generally designated 20, includes a seat 22 which is pivotally attached to a pair of support arms 24, 26 which are, in turn, mounted on a base 28. The base includes a rear support member 30 which is positioned beneath the seat 22. The seat 22 includes a tubular seat frame which includes upper and lower U-shaped tubular members 34, 36, respectively. The ends of lower member 36 are of a lesser diameter than, and are telescoped into the ends of upper component 34, and are secured by screws 37 (only one screw 37 is shown in FIG. 3, it being understood that a second screw is similarly positioned in the opposite side of frame 32).

The lower member 36 is angled outwardly from the plane of the upper component 34 to provide leg support for an infant in the seat 22. A quilted fabric seating surface 38 is mounted on seat frame 32 and includes an adjustable waist strap 40 and pelvic panel 42. The waist strap 40 is attached to the seating surface 38 and is threaded through a sleeve 44 formed in the pelvic panel 42.

The support arms 24, 26 are connected to the seat 22 by pivot assemblies, generally designated 46, 48. The discussion of the structure of the pivot assemblies will be with reference to pivot assembly 48 shown in FIGS. 5, 6, 7 and 8, it being understood that the structure of pivot assembly 46 and its connection to arm 24 are identical, but of reverse hand. Pivot assembly 48 includes first and second pivot connections 50, 52.

Pivot connection 50 includes a rivet 54 which is journaled through holes 56, 58 in support arm 26 and frame member 34 respectively. A spacer bushing 60 is mounted on the rivet 54 between support arm 26 and frame member 34 to provide clearance between the frame member and arm sufficient to accommodate the second pivot connection 52.

Second pivot connection 52 includes a J-shaped bracket 62 which is secured to upper frame member 34 by a rivet 63 and extends downwardly and sidewardly from the frame member. A pivot plate 64 is pivotally attached to the bracket 62 by a rivet 66 received within hole 68. The pivot plate 64 includes a scalloped lower edge 69 which provides a hand grip. The pivot plate includes a recess 70 shaped to receive an L-shaped slot plate 72. Slot plate 72 includes an elongate slot 74 having a constriction 76 at a forward end thereof. Slot plate 72 is retained within the recess 70 by the rivet 66 and by a lip 78 formed in the pivot plate 64.

Figure 5:
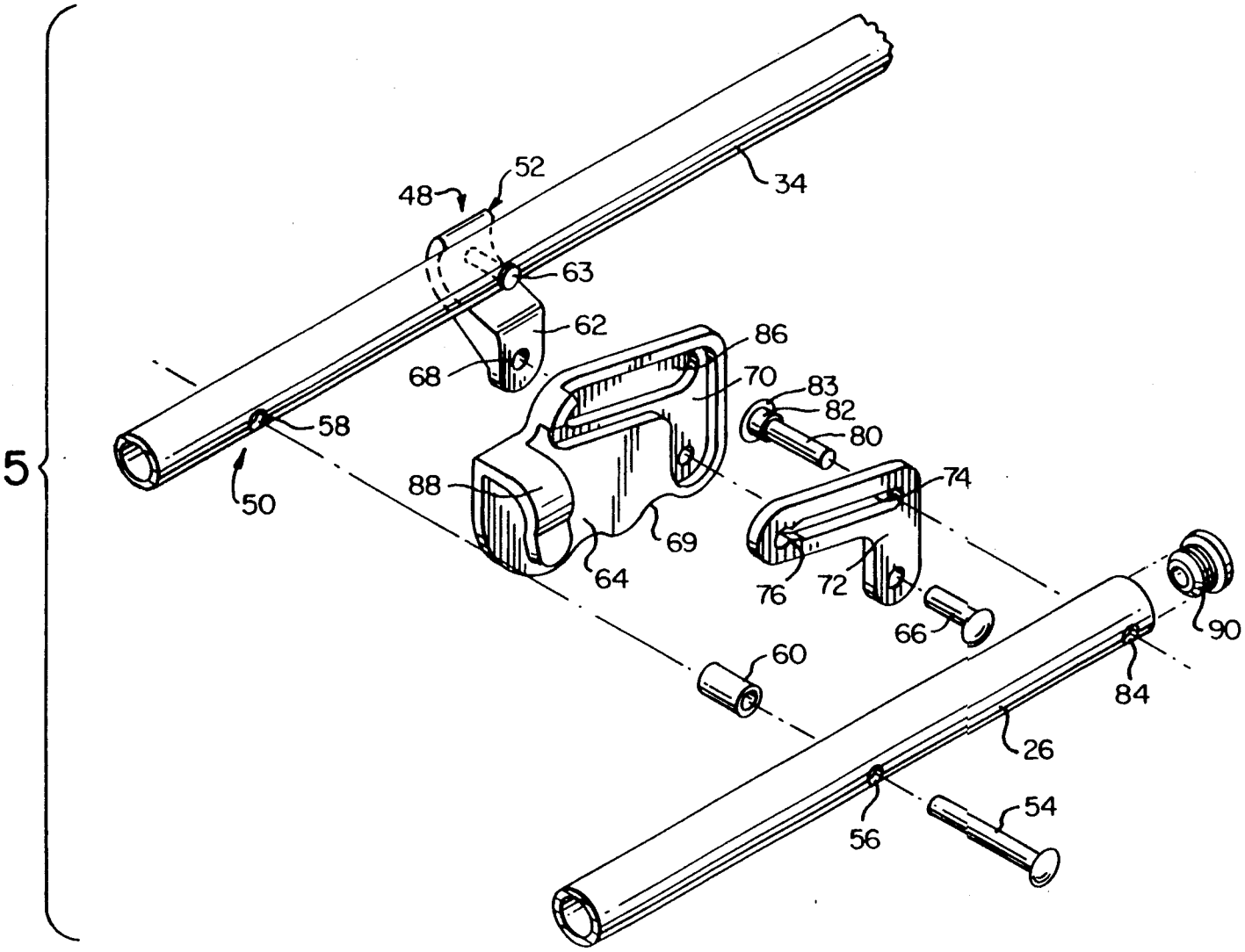
FIG. 5 is a detail showing a perspective, exploded view of a pivot connection between the seating frame and a support arm of the infant seat of FIG. 1.

Shoulder rivet 80 includes a shoulder 82 which engages the slot 74 and is retained by shoulder rivet head 83. Shoulder rivet 80 is attached to support arm 26 through hole 84. Clearance for the head 83 is provided by a head recess 86 formed in pivot plate 64. Pivot plate 64 includes a sidewardly-extending clip 88 shaped to receive the support arm 26 in an interference fit, as shown in FIG. 5 (see also FIGS. 1 and 3). A plastic end cap 90 seals the end of the support arm 26.

As shown in FIGS. 1 and 2, the seat 22 pivots between an upright configuration, shown in FIG. 1 and a reclined configuration shown in FIG. 2. The seat 22 pivots about a horizontal axis A (see FIG. 2) defined by rivets 54 of the first pivot connections 50 (see FIGS. 6 and 8). When in the upright configuration, as shown in FIGS. 1 and 5, the shoulder rivets 80 are positioned at the rearward ends of the cam slots 74. When in this configuration, the clips 88 engage the support arms 24, 26 to maintain the seat 22 in this configuration.

Figure 6:
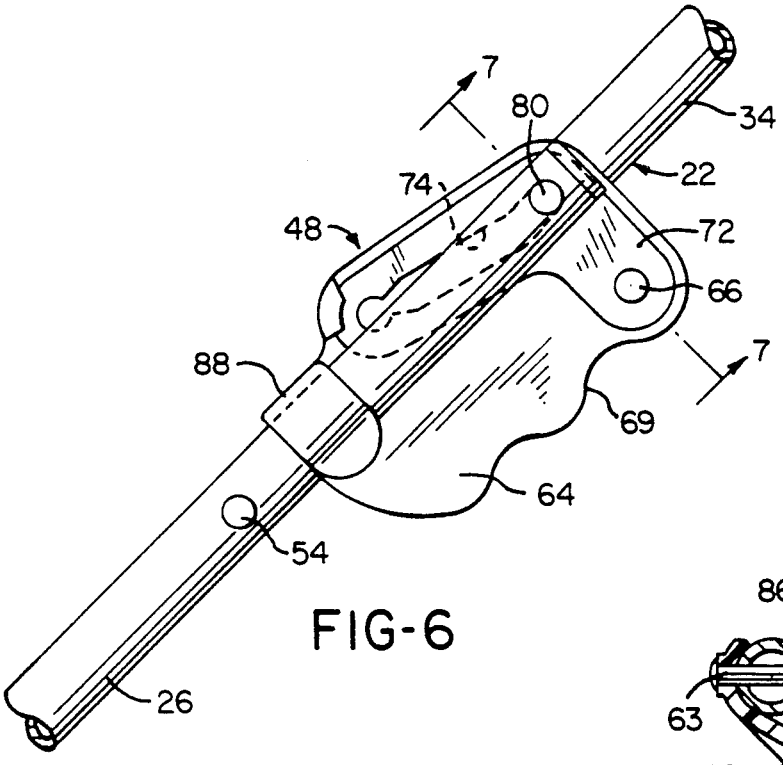
FIG. 6 is a detail showing a side elevation of the pivot connection of FIG. 5.
Figure 8:
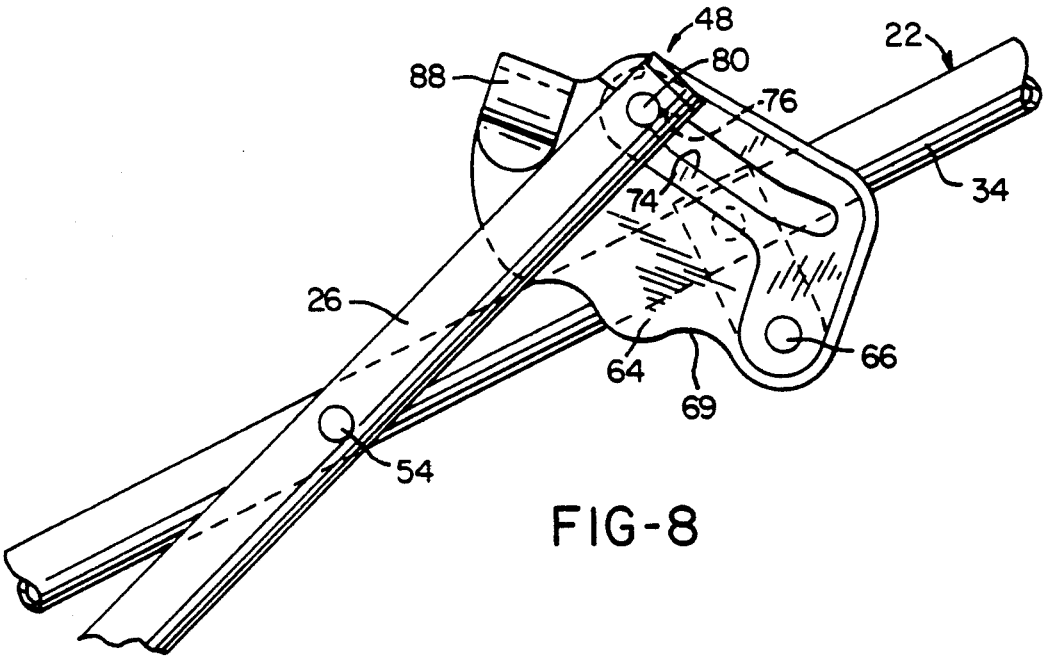
FIG. 8 is a detail of the pivot connection of FIG. 6, adjusted to a reclined position.

As the seat is pivoted to a reclined configuration, the seat 22 pivots about rivets 54 and the pivot plates 64 pivot about rivets 66. The pivoting movement is effected by grasping the scalloped edges 69 of the pivot plates 64, placing the thumbs on the support arms 24, 26, and squeezing, thereby disengaging the clips 88 (FIGS. 6 and 8). At the same time, shoulder rivets 80 slide along slots 74 until they reach the constrictions 76 at the forward ends of the slot. The cam plates 64 are, at the same time, pivoting relative to the shoulder rivets 80.

Figure 7:
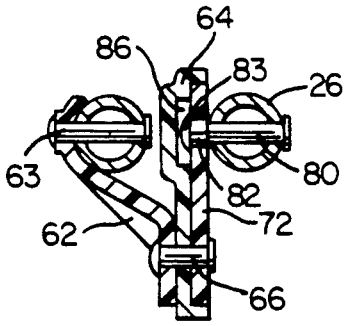
FIG. 7 is a cross section taken at line 7—7 of FIG. 6.

When fully adjusted to the reclined configuration, the pivot plates 64 appear as in FIG. 7 for pivot assembly 48. When in this configuration, the clips 88 are disengaged from the support arms 24, 26, and the seat 22 is held in the reclined position by the interference fit between the shoulder rivet 80 and the constrictions 76 of the slot 74, as shown in FIG. 8 for pivot assembly 48.

Figure 9:
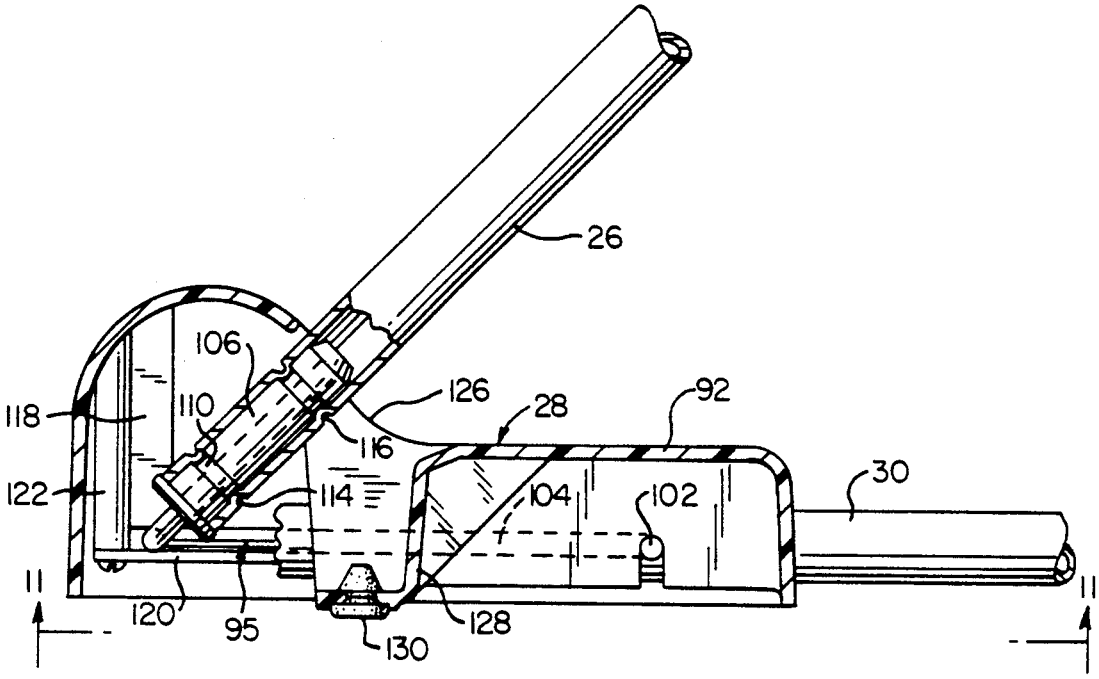
FIG. 9 is a side elevation, in section, taken at line 9—9 of FIG. 1, in which the support arm is partially broken away.
Figure 10:
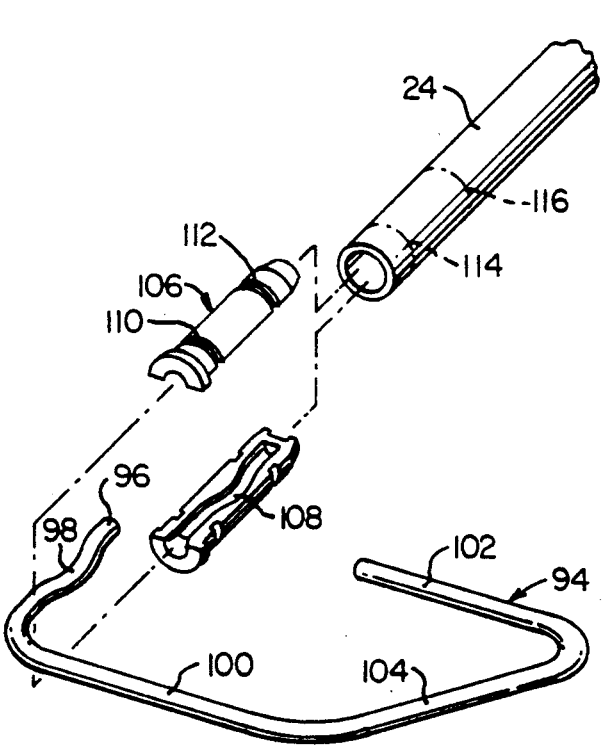
FIG. 10 is a detail showing an exploded, perspective view of the torsion spring, bushing and associated support arm of the infant seat of FIG. 1.
Figure 11:
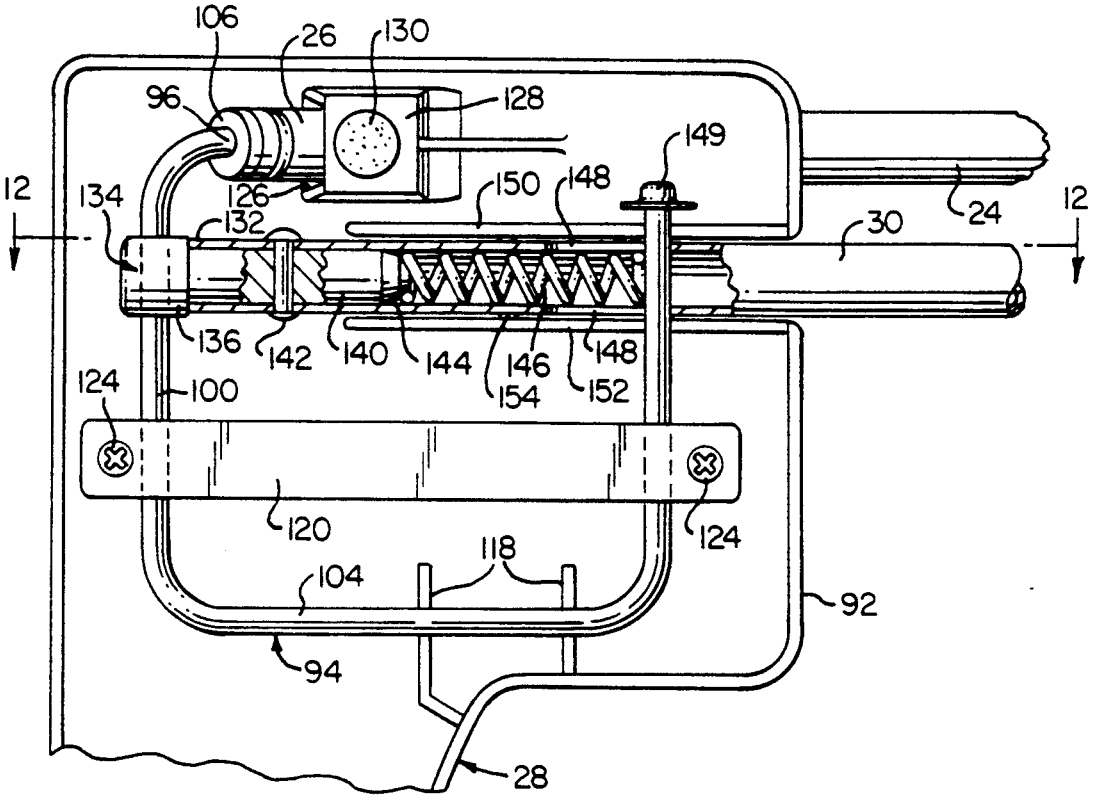
FIG. 11 is a partial bottom plan view taken at line 11—11 of FIG. 9.
Figure 12:
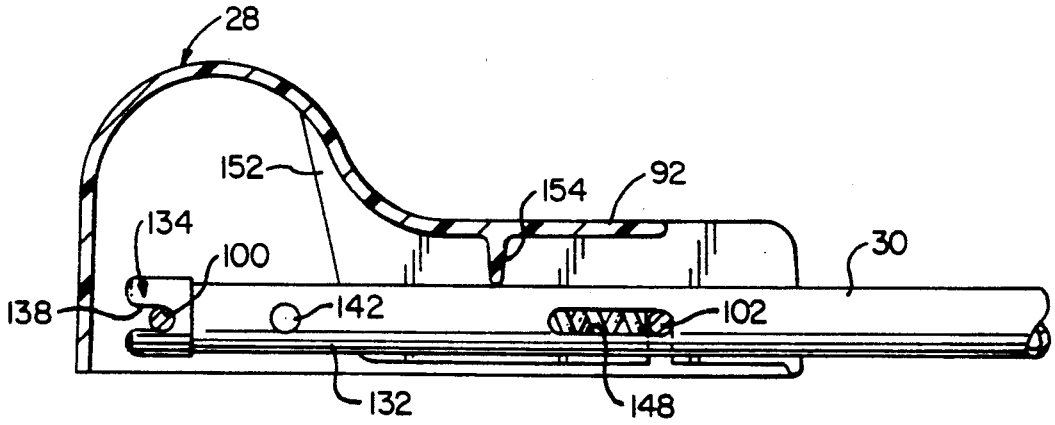
FIG. 12 is a side elevation, in section, taken at line 12—12 of FIG. 11.

As shown in FIGS. 9, 11 and 12, the base 28 includes a plastic housing 92 within which are mounted a pair of torsion springs 94, 95 (see also FIG. 10) attached to and supporting the support arms 24, 26, respectively. The description of the torsion springs 94, 95 and their relation to the housing 92 and support arms 24, 26 is shown in FIGS. 9, 10, 11 and 12 alternately for springs 94 or 95 and support arms 24 or 26, it being understood that the structure illustrated for one of the torsion spring and support arm pairs is identical to the corresponding structure of the other pair not illustrated.

Torsion springs 94, 95 include an inclined segment 96 having an offset portion 98, a forward segment 100, a rearward segment 102, oriented substantially parallel to the forward segment, and a side segment 104 extending between the forward and rearward segments. Preferably, the torsion springs 94, 95 are made of a continuous length of spring steel bent into the configuration shown.

The inclined segment 96 of each of the torsion springs 94, 95 is received by a split bushing 106 having a curvlinear passage 108 shaped to conform to the offset portion 98. The bushings 106 are sized to be received within the ends of the support arms 24, 26 and include a pair of peripheral, annular grooves 110, 112. Grooves 110, 112 engage corresponding constrictions 114, 116, respectively, formed in the ends of the arms 24, 26.

The torsion springs 94, 95 are supported by ribs, generally designated 118 (see FIGS. 9 and 11), and are secured against the ribs by a mounting plate 120 attached to bosses 122 by screws 124. The housing 92 includes openings 126 through which extend the support arms 24, 26. The housing 92 includes legs 128, positioned beneath the openings 126, each having a non-skid foot 30.

As shown in FIGS. 11 and 12, the rear support member 30 includes ends 132 (only one end 132 is shown in FIGS. 11 and 12) which receive nock fittings 134. The structure of the ends 132 will be described in reference to FIGS. 11 and 12 with respect to that end of the rear support member 30 associated with support arm 24, it being understood that the opposite end of the support member associated with the support arm 26 is of identical construction. Nock fitting 134 includes a head 136 having a notch 138 shaped to receive the forward segment of torsion spring 94 and abut the squared end of end 132.

Nock fitting 134 also includes cylindrical shank 140 which is retained within the end 132 by a rivet 142. Shank 140 terminates in a spring seat 144 that receives a coiled extension spring 146. End 132 includes a pair of slots 148 positioned to receive the rearward segment 102 therethrough. The segment 102 is secured by an axle cap 149.

Extension spring 146 urges against the rearward segment 102 and against the spring seat 144 to urge the end 132 of the support member 30 against the forward segment 100, thereby maintaining engagement between the forward segment and the head 136. End 132 is captured between walls 150, 152 formed in the base housing 92 and thereby is prevented from lateral movement relative to the base and torsion spring 94. A stop 154 extends between walls 150, 152 and engages end 132 when the infant seat 20 is configured as shown in FIGS. 1 and 2. Stop 154 prevents end 132 from improperly engaging forward segment 100.

Figure 4:
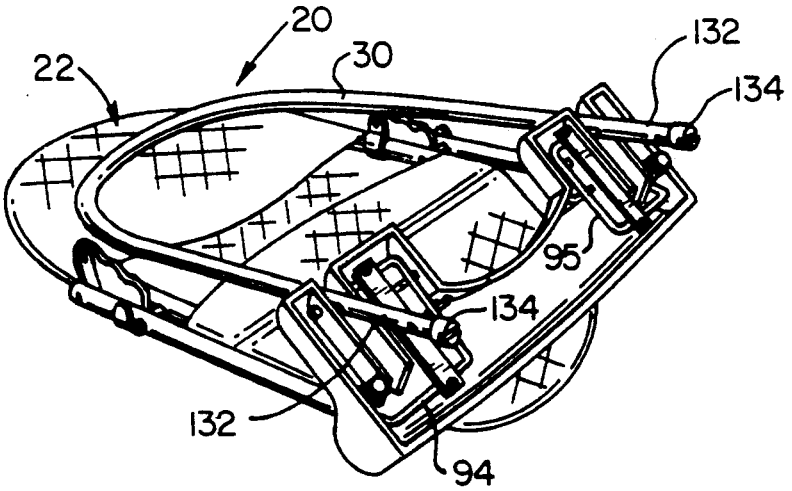
FIG. 4 is a perspective view of the infant seat of FIG. shown in a collapsed configuration.

The rear support member 30 can be disengaged from the forward segments 100 of the torsion springs 94, 95 and pivoted about the rearward segments 102 to the collapsed configuration shown in FIG. 4, which is ideal for storage or carrying. This is achieved by pulling the rear support member 30 away from the base housing 92 sufficiently to disengage the nock fittings 134 from their respective forward segments 100. This displacement causes the rearward segments 102 to move relative to the slots 148 and compress their respective springs 146. Once the nock fittings 134 are disengaged from their respective forward segments 100, the rear support member 30 may be pivoted to the collapsed configuration, in which the rear support member is adjacent to the seat 22, shown in FIG. 4.

To adjust the infant seat 20 to the support configuration shown in FIGS. 1 and 2, this procedure is reversed. The rear support member 30 is pulled rearwardly from the base housing 92, pivoted to the support configuration wherein it is substantially coplanar with the base housing, and released. The springs 146 then extend to urge the nock fittings 134 to engage the forward segments 100. Proper orientation of the support member 30 relative to base 28 is ensured by stops 154, which prevent over-rotation of the support member about rearward segment 102.

An advantage of this invention over prior art infant seats is that an infant can bounce in the seat when the seat is adjusted either to the upright or to the reclined positions. By adjusting the seat to the reclined position, the center of gravity of the infant in the seat is shifted rearwardly away from the torsion springs, which provides greater leverage and increases the torque applied to the torsion springs for a given infant weight, when compared to an upright seat. Consequently, smaller and lighter infants, who are more comfortable in a reclined position, can effect bouncing action with the infant seat of the present invention in the reclined position similar to that of larger, heavier infants in the seat when adjusted to the upright position.

The support arms 24, 26, rear support member 30 and seat frame 32 preferably are made of 1010-1020 steel tubing, $\frac{5}{8}''$ diameter, 22 gauge. The pivot plate 64 preferably is made of a nylon, as is the bracket 62.

While the form of apparatus herein described constitutes a preferred embodiment of this invention, it is to be understood that the invention is not limited to this precise form of apparatus, and that changes may be made therein without departing from the scope of the invention.

What is claimed is:

1. An infant seat comprising:

a seat frame for supporting an infant seating surface;

a base having a pair of support arms;

each of said support arms having a pivot assembly for connecting said support arm to said seat frame, each of said pivot assemblies having first and second pivot connections between an associated one of said support arms and said seat frame, said second pivot connections each including a pivot plate pivotally connected to said seat frame and pivotally connected to said associated support arm, whereby said seat frame pivots about said first pivot connections to upright and reclined positions;

each of said pivot plates including a slot and said pivotal connection of said pivot plate to said associated support arm includes a shoulder rivet slidably positioned in said slot and connected to said associated support arm;

at least one of said pivot plates including clip means for securing said seat frame in said upright position against an adjacent one of said support arm; and each of said slots is formed in a slot plate, said slot plates being mounted on said pivot plates.

2. The infant seat of claim 1 wherein said second pivot connections define a range of pivotal movement of said seat.

3. The infant seat of claim 1 wherein said pivot plates each include a recess receiving said slot plate and a lip, adjacent to said recess, for retaining said slot plate in said recess.

4. The infant seat of claim 1 wherein said pivotal connection between each of said pivot plates and said seat frame includes a seat bracket attached to and projecting from said seat frame, said seat brackets being pivotally attached to said pivot plates.

5. The infant seat of claim 4 wherein said seat frame is positioned between said support arms, and said pivot plates are positioned between said support arms and said seat frame.

6. The infant seat of claim 5 wherein said support arms are oriented substantially parallel to each other.

7. The infant seat of claim 6 wherein at least one of said slots includes a constriction at an end thereof shaped to retain an associated one of said shoulder rivets in a releasable interference fit, said interference fit retaining said seat frame in said reclined position.

8. An infant seat comprising:

a tubular seat frame;

a fabric seating surface enclosing said seat frame;

a base including a base housing;

a pair of tubular support arms extending upwardly from said housing and oriented substantially parallel to each other, said support arms being positioned on either side of said seat frame;

each of said support arms including a pivot assembly having first and second pivot connections between an associated one of said support arms and said seat frame;

said first pivot connections each including a first rivet pivotally connecting said seat frame to said associated support arm;

said second pivot connections each including a pivot plate pivotally connected to said seat frame and having a recess, a slot plate mounted in said recess and having a slot with a restriction at an end thereof, a lip for retaining said slot plate in said recess and a second rivet retaining said slot plate in said recess and forming a pivot connection between said slot plate and said seat frame;

a pair of shoulder rivets attached to said support arms, each of said shoulder rivets having a shoulder captured in an associated one of said slots and forming a pivotal connection between one of said pivot plates and said associated support arm, said shoulder rivet engaging said restriction to form an interference fit therewith when said frame is pivoted to a reclined position;

a clip extending from said pivot plate and shaped to engage said associated support arm when said frame is pivoted to an upright position; and a seat bracket extending downwardly from said seat from between said frame and each of said pivot plates for receiving said second rivet.

9. An infant seat comprising:

a seat shaped to support an infant;

a pair of support arms connected to said seat for supporting said seat;

means for forming a pivot point including a pivot pin between said seat and said arms such that said seat pivots continuously about said pivot point to a generally upright position and a generally reclined position;

base means for holding said support arms at an elevated position; and resilient means connected to said base means for imparting a bouncing action to said seat in both said upright and reclined positions.

10. The infant seat of claim 9 wherein said resilient means is connected to said support arms.

11. The infant seat of claim 10 wherein said means for forming a pivot point includes a pair of pivot points attaching said arms to said seat.

12. The infant seat of claim 11 wherein said resilient means includes a pair of torsion springs, each connected to one of said support arms.

13. The infant seat of claim 9 wherein said means for forming a pivot point includes means for pivoting said seat to said reclined position such that a center of gravity of an infant in said seat is shifted rearwardly from said base means whereby greater leverage and easier bouncing action is achieved than when said seat is in said upright position.

14. An infant seat comprising:

a seat shaped to support an infant;

a pair of support arms connected to said seat for supporting said seat;

means for forming a pivot point including a pivot pin between said seat and said arms such that said seat pivots continuously about said pivot point to a generally upright position and a generally reclined position;

base means for holding and support arms at an elevated position;

resilient means connected to said base means for imparting a bouncing action to said seat in both said upright and reclined positions; and said means for forming a pivot point positioning said seat, when in said reclined position, relative to said support means such that a center of gravity of an infant in said seat is shifted to provide greater leverage so that said bouncing action is facilitated.

15. An infant seat comprising:

a seat frame for supporting an infant seating surface;

a base having a pair of support arms;

each of said support arms having a pivot assembly for connecting said support arm to said seat frame, each of said pivot assemblies having first and second pivot connections between an associated one of said support arms and said seat frame, said second pivot connections each including a pivot plate pivotally connected to said seat frame and pivotally connected to said associated support arm, whereby said seat frame pivots about said first pivot connections to upright and reclined positions;

each of said pivot plates including a slot and said pivotal connection of said pivot plate to said associated support arm includes a shoulder rivet slidably positioned in said slot and connected to said associated support arm; and at least one of said slots including a constriction at an end thereof shaped to retain an associated one of said shoulder rivets in a releasable interference fit, said interference fit retaining said seat frame in said reclined position.

* * * * *